US009446929B2

(12) United States Patent
Jang et al.

(10) Patent No.: US 9,446,929 B2
(45) Date of Patent: Sep. 20, 2016

(54) STEEL STRIP STABILIZING APPARATUS

(75) Inventors: Tae-In Jang, Gwangyang-si (KR); Yong-Hun Kweon, Gwangyang-si (KR); Jung-Kuk Kim, Gwangyang-si (KR); Chang-Woon Jee, Gwangyang-si (KR)

(73) Assignee: POSCO, Pohangi-si (KR)

( * ) Notice: Subject to any disclaimer, the term of this patent is extended or adjusted under 35 U.S.C. 154(b) by 440 days.

(21) Appl. No.: 13/992,050

(22) PCT Filed: Dec. 5, 2011

(86) PCT No.: PCT/KR2011/009354

§ 371 (c)(1),
(2), (4) Date: Aug. 26, 2013

(87) PCT Pub. No.: WO2012/077947

PCT Pub. Date: Jun. 14, 2012

(65) Prior Publication Data

US 2013/0327806 A1 Dec. 12, 2013

(30) Foreign Application Priority Data

Dec. 10, 2010 (KR) ..... 10-2010-0126457

(51) Int. Cl.

| | |
|---|---|
| ***C23C 2/00*** | (2006.01) |
| ***B05C 3/00*** | (2006.01) |
| ***B65H 57/00*** | (2006.01) |
| ***C23C 2/14*** | (2006.01) |
| ***C23C 2/40*** | (2006.01) |

(52) U.S. Cl.

CPC ..... *B65H 57/006* (2013.01); *C23C 2/003* (2013.01); *C23C 2/006* (2013.01); *C23C 2/14* (2013.01); *C23C 2/40* (2013.01); *B05C 3/00* (2013.01)

(58) Field of Classification Search

None

See application file for complete search history.

(56) References Cited

U.S. PATENT DOCUMENTS

| | | | | |
|---|---|---|---|---|
| 5,538,558 | A * | 7/1996 | Ookouchi et al. | 118/423 |
| 2008/0044584 | A1 | 2/2008 | Eriksson | |
| 2009/0175708 | A1 | 7/2009 | Lofgren et al. | |
| 2010/0285239 | A1 | 11/2010 | Behrens | |

FOREIGN PATENT DOCUMENTS

| | | | |
|---|---|---|---|
| CN | 101146925 | A | 3/2008 |
| CN | 101698927 | A | 4/2010 |
| EP | 2188403 | A2 | 5/2010 |
| JP | 56-093648 | | 7/1981 |
| JP | 2000053295 | A | 2/2000 |

(Continued)

*Primary Examiner* — Dah-Wei D Yuan
*Assistant Examiner* — Jethro M Pence
(74) *Attorney, Agent, or Firm* — The Webb Law Firm

(57) ABSTRACT

Provided is a steel strip stabilizing apparatus which dampens vibrations of a plated steel strip in a non-contact manner or corrects the shape of the plated steel strip. The steel strip stabilizing apparatus comprises: a plurality of steel strip damping means arranged on at least one side of a steel strip undergoing processing in a direction there towards so as to damp vibrations in the steel strip; and a damping means moving unit connected to the steel strip damping means to move at least a portion of each of the steel strip damping means in a widthwise direction with regard to the steel strip corresponding to the width of the steel strip. According to the present invention, (unit) damping means are movable in the widthwise direction with regard to the steel strip, thus improving the vibration damping properties, the steel strip curvature correcting properties and the plated quality of the steel strip.

3 Claims, 7 Drawing Sheets

(56) References Cited

FOREIGN PATENT DOCUMENTS

| | | | |
|---|---|---|---|
| JP | 2001062509 | A | 3/2001 |
| JP | 2002-285309 | | 10/2002 |
| JP | 2002294420 | A | 10/2002 |
| JP | 2002317259 | A | 10/2002 |
| JP | 2003-293111 | | 10/2003 |
| JP | 2007-092161 | A | 4/2007 |
| KR | 1020050005846 | A | 1/2005 |
| KR | 1020070048191 | A | 5/2007 |
| KR | 1020100098142 | A | 9/2010 |

* cited by examiner

STEEL STRIP STABILIZING APPARATUS

TECHNICAL FIELD

The present invention relates to a steel strip stabilizing apparatus which dampens vibrations in a steel strip or corrects the shape (curvature) of the steel strip, and more particularly, to a steel strip stabilizing apparatus provided to correspond to the width of the steel strip such that (unit) damping means are movable in the widthwise direction with regard to the steel strip, thus improving vibration damping properties, and the correcting properties of correcting the curvature (C-shaped curvature or S-shaped curvature) of the steel strip, resulting in enhancements in the plating quality of the steel strip.

BACKGROUND ART

Demand for (zinc) plated steel strips, which enhance corrosion resistance, etc., have desirable aesthetic qualities, and are particularly used as steel sheets for electronic products or automobiles, has rapidly increased, and requirements for the quality of (zinc) plated steel strips have also increased.

Although not shown in a separate drawing, a zinc plating process for steel strips is, for example, performed by allowing molten zinc to be attached to surfaces of a steel strip while the steel strip is unwound from a pay off reel and passes through a snout and a plating bath in an in situ process.

At this time, a gas wiping apparatus (for example, an air knife) provided directly above the plating bath sprays a gas (an inert gas or air) onto a surface of the steel strip to properly reduce the amount of zinc attached to the surface of the steel strip, thereby controlling the plating thickness of the steel strip.

At this time, since various types of steel strip may be passed through the plating bath, widths, thicknesses and loads applied to (a shaft of) a sink roll in the plating bath are different, depending on the type of the steel strip, while the steel strip that has passed through the sink roll and a stabilizing roll passes through an upper transfer roll, vibrations in the steel strip occur or a curvature (C-shaped curvature or S-shaped curvature) phenomenon in which the steel strip is curved occurs even though the vibrations and curvature may vary with the type, the width or the thickness of the steel strip.

The occurrence of vibrations or a curvature phenomenon may cause the interval between the gas wiping apparatus and the steel strip to be non-uniform, to thus generate a plating deviation, resulting in a plating failure.

Therefore, although not shown in a separate drawing, at least one steel strip stabilizing apparatus for suppressing vibrations in the steel strip or correcting the shape thereof is disposed between the gas wiping apparatus and the upper transfer roll.

For example, an existing steel strip stabilizing apparatus ("steel strip damping apparatus or shape correcting apparatus") dampens (suppresses) the vibrations in the plated steel strip or removes the curvature thereof to thus correct the shape of the steel strip, thus preventing the occurrence of deviations in plating by using a mechanical touch roll contacting the steel strip or spraying a gas onto the steel strip.

However, in the case of using the mechanical touch roll, since the roll contact is performed in a state in which the zinc layer plated on the steel strip is completely unattached (dried), a secondary quality defect, such as a surface roll marker may be caused.

Therefore, a non-contact type steel strip stabilizing apparatus (damping mechanism) using electromagnetic force, which realizes vibration damping of a steel strip in a non-contact manner or corrects the shape of the steel strip has also been used recently.

However, as explained through FIG. 5A of the present invention, the existing steel strip stabilizing apparatus using electromagnetic force is problematic in that the positions of unit damping blocks (damping means) are fixed with respect to the steel strip in a widthwise direction thereof.

For example, in the case of the existing non-contact type steel strip stabilizing apparatus using electromagnetic force, since 5 to 7 damping units (electromagnet blocks) are fixedly disposed per side of the steel strip, the unit damping units have difficulty in controlling the position while moving, corresponding to various widths of the steel strips.

Therefore, when the width of a steel strip is changed, particularly when an edge of the steel strip is positioned in a space (gap) between the damping blocks, an unstable damping region (shape correcting region) is generated while a discontinuous boundary surface is formed.

That is, when an edge portion of the steel strip is positioned between the damping means in which a magnetic field is not formed, it is difficult to apply a uniform degree of electromagnetic force in the widthwise direction with regard to the steel strip, and problems, such as an increase in vibrations or instability in the shape of the steel strip may occur while the damping capability is reduced at the edge of the steel strip.

Therefore, in the case of the existing steel strip stabilizing apparatus, it is necessary to arrange as many unit damping units as possible in the widthwise direction with regard to the steel strip. In consideration of the maximum width of currently available plated steel strips, at least seven damping units are required to reduce an interval therebetween, such that the steel strip damping capability or the shape correcting capability is not reduced due to the formation of the discontinuous boundary surface explained above.

Therefore, since the existing steel strip stabilizing apparatus needs a lot of unit damping units, facility establishment costs or facility maintenance costs may be high.

SUMMARY OF THE INVENTION

The present invention is intended to solve the above-mentioned drawbacks occurring in the related art, and it is an object of the present invention to provide a steel strip stabilizing apparatus which allows a unit damping means to be movable to prevent the damping capability from being reduced or prevent vibrations from increasing in an edge portion of a steel strip, and to make it easy to correct the shape of the steel strip, resulting in enhancement of the plating quality of the steel strip.

Another aspect of the present invention is to provide a steel strip stabilizing apparatus that may prevent a discontinuous boundary surface from being formed in an edge portion of a steel strip even when the number of unit damping means (blocks) is decreased, thus decreasing costs for the establishment of facilities or for the maintenance of the apparatus.

According to an aspect of the present invention, there is provided a steel strip stabilizing apparatus including: a plurality of steel strip damping means arranged on at least one side of a steel strip undergoing processing in a direction there towards so as to damp vibrations in the steel strip or to correct the shape of the steel strip; and a damping means moving unit connected to the steel strip damping means to move at least a portion of each of the steel strip damping means in a widthwise direction with regard to the steel strip corresponding to the width of the steel strip.

The above steel strip stabilizing apparatus may further include a damping means support fixed to an apparatus casing, wherein the plurality of steel strip damping means are connected to the damping means support in multistage configuration, and at least one of the plurality of steel strip damping means connected to the damping means support in the multistage configuration is connected to the damping means moving unit.

The steel strip damping means may include a central side damping means disposed at a traveling center of the traveling steel strip, and at least one moving side damping means arranged in the widthwise direction with regard to the steel strip on both sides of the central damping means and are connected to the damping means moving unit.

The steel strip damping means may include a body part disposed on at least one side of the traveling steel strip; and a magnetic field generating pole provided to the body part to damp vibrations in the steel strip.

The damping means moving unit may include: a screw bar rotatably provided to the apparatus casing in the widthwise direction with regard to the steel strip and is coupled to a moving block connected to the body part of the steel strip damping means; and at least one guide provided to the apparatus casing while passing through the body part of the steel strip damping means.

The screw bar is comprised of double screw bars having different screw directions with the central side damping means as a starting point, and when the screw bar rotates, the moving side damping means positioned on both sides of the central side damping means are close to or distant from each other with the same moving width; and the screw bar is alternately connected to the moving side damping means at upper and lower sides thereof.

The guide of the damping means moving unit may be provided to allow the damping means to be easily moved while passing through a liner ring provided to a guide support block attached to the body part of the steel strip damping means, a driving motor which may be connected to the screw bar of the damping means moving unit and is equipped in the apparatus casing is connected to a device controller, and a steel strip edge sensor provided on both sides of the apparatus casing may be connected to the device controller.

The apparatus casing may be further provided with a steel strip transfer roll for guiding the direction of travel of the steel strip.

In addition, the means for solving the problem does not list all features of the present invention. Further features, advantages and effects of the present invention will become apparent from the following description of exemplary embodiments with reference to the attached drawings.

According to the present invention, unit damping means are movable in the widthwise direction with regard to the steel strip to prevent the damping capability or the shape correction capability from being reduced at the edge of the steel strip, and to prevent the amplification of vibrations, thus improving the plating quality of the steel strip.

Additionally, according to the present invention, the shape correction of correcting the curvature of a steel strip, for example, a C-shaped curvature or S-shaped curvature may be effectively performed.

Also, the present invention solves the existing problem in at least an edge portion of the steel strip even when the number of the unit damping means (blocks) decreases, thus decreasing the maintenance costs.

DETAILED DESCRIPTION OF THE INVENTION

Hereinafter, detailed descriptions will be provided with reference to the accompanying drawings.

Figure 1:
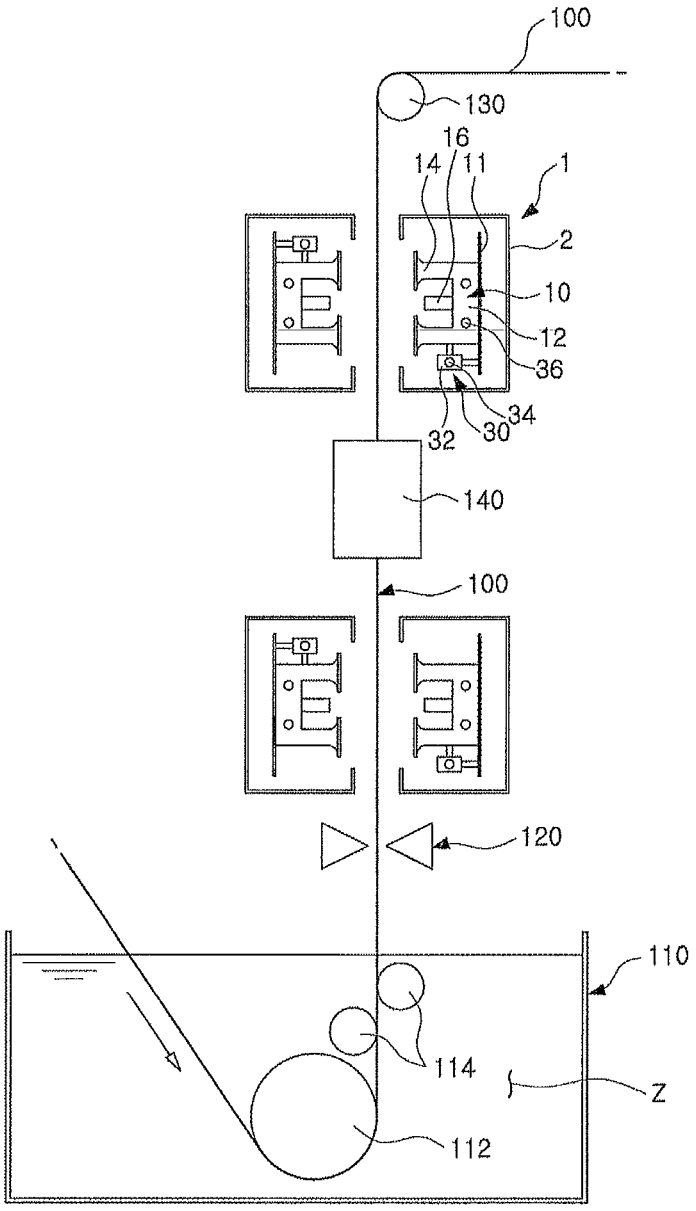
FIG. 1 is a schematic view showing the installation state of a plating line in a steel strip stabilizing apparatus according to the present invention.

First, FIG. 1 illustrates the installation state of a plating line of a steel strip stabilizing apparatus 1 provided corresponding to the width of a steel strip.

While in the following embodiments it is described that the steel strip stabilizing apparatus 1 of the present invention dampens vibrations in a steel strip 100, which passes through a plating bath 110 and is plated with zinc, or corrects the shape of the plated steel strip, it is natural that the steel strip stabilizing apparatus 1 should not necessarily only be installed on the plating line but may be applied to other fields so as to suppress vibrations in steel strips which move continuously.

For example, there is no problem in applying the steel strip stabilizing apparatus of the present invention to a continuous surface treatment of a steel strip in other fields in which vibrations or curvature generated during the traveling of the steel strip affect the production of the steel strip or the quality of the steel strip.

Also, it is natural that the steel strip stabilizing apparatus 1 of the present invention be symmetrically disposed on both sides of a traveling line of the steel strip in aspects of uniform and stable vibration damping of the steel strip and correction of the shape.

Next, as shown in FIG. 1, a zinc plating line for plating of a steel strip to which the steel strip stabilizing apparatus 1 is applied is configured such that a steel strip (cold rolled steel strip) 100 unwound from a pay off reel is heat-treated via a welding machine and a looper and then molten zinc (Z) is attached to a surface of the steel strip to perform the zinc plating while passing through a snout and a zinc plating bath 110.

At this time, a gas wiping apparatus 120 (air knife) provided directly above the plating bath sprays a gas (inert gas or air) onto a surface of the steel strip to properly reduce the amount of zinc attached to the steel strip, thereby controlling the plating thickness of the steel strip.

The plated steel strip travels via a sink roll 112 of the plating bath 110, a stabilizing roll 114, and an upper transfer roll 130.

At this time, as shown in FIG. 1, the temperature of molten zinc present in the plating bath 110 is in a range of about 450-460° C., and the steel strip 100 passing through the plating bath 110 has various types, widths or thicknesses.

Then, while a load applied to (a roll shaft of) the sink roll 112 in FIG. 1 varies with the type of the steel strip, the maximum load of 500 kgf may be applied to both ends of the sink roll. Therefore, when dynamic behavior, such as vibrations, occurs, a maximum load of 100 kgf may act in a rotational direction of the sink roll.

Therefore, while the plated steel strip 100 that has passed through the sink roll 112 and the stabilizing roll 114 travels via the upper transfer roll 130, vibrations in the steel strip or a curvature phenomenon of the steel strip in the widthwise direction occur, even though the vibration or curvature phenomenon may differ depending on the type, width or thickness of the steel strip, thus causing plating deviations in the gas wiping apparatus 120, resulting in a plating failure of the steel strip.

That is, as shown in FIG. 1, the steel strip stabilizing apparatus 1 of the present invention configured corresponding to the width of the steel strip is disposed between the gas wiping apparatus 120 and the upper transfer roll 130 at an upper side and a lower side of a steel strip cooling apparatus 140 (for example, mist cooler), respectively.

Resultantly, the steel strip stabilizing apparatus 1 of the present invention dampens or suppresses vibrations in the plated steel strip 100 to prevent the occurrence of plating deviations.

Meanwhile, as demand for steel strips plated with zinc sharply increases, a line speed (traveling speed) of the steel strip increases to facilitate production. Since the increase in the line speed of the steel strip may cause the vibrations in the steel strip to be amplified, the steel strip stabilizing apparatus 1 of the present invention is important.

For example, when the vibrations in the steel strip are decreased or the curvature of the steel strip is corrected, the deviation of the plated amount may be decreased, the amount of zinc attached to the steel strip in the widthwise direction thereof may be controlled, and an alloying failure may be decreased.

Meanwhile, the steel strip stabilizing apparatus 1 of the present invention, configured corresponding to the width of the steel strip, is shown in FIGS. 1 to 4. Elements associated with the device of the present invention will be explained with reference numerals in tens, while elements associated with the plating line will be explained with reference numerals in hundreds.

Figure 2:
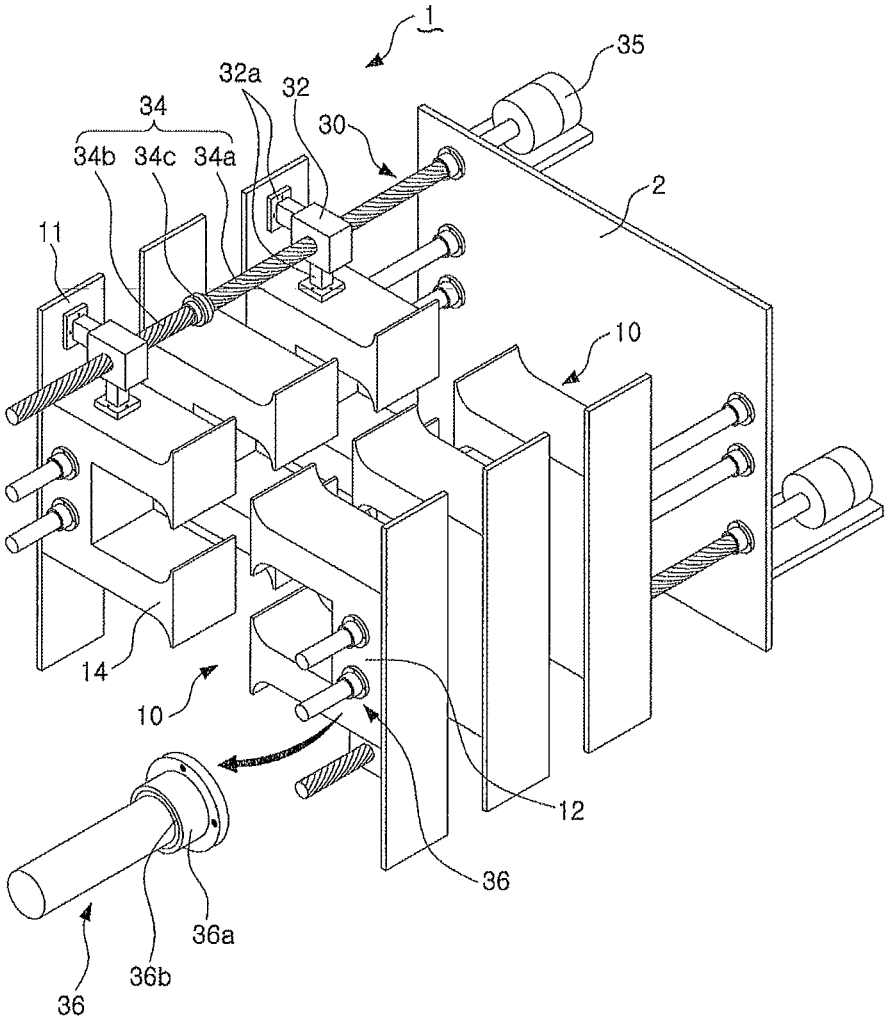
FIG. 2 is a perspective view of a steel strip stabilizing apparatus according to the present invention.
Figure 3:
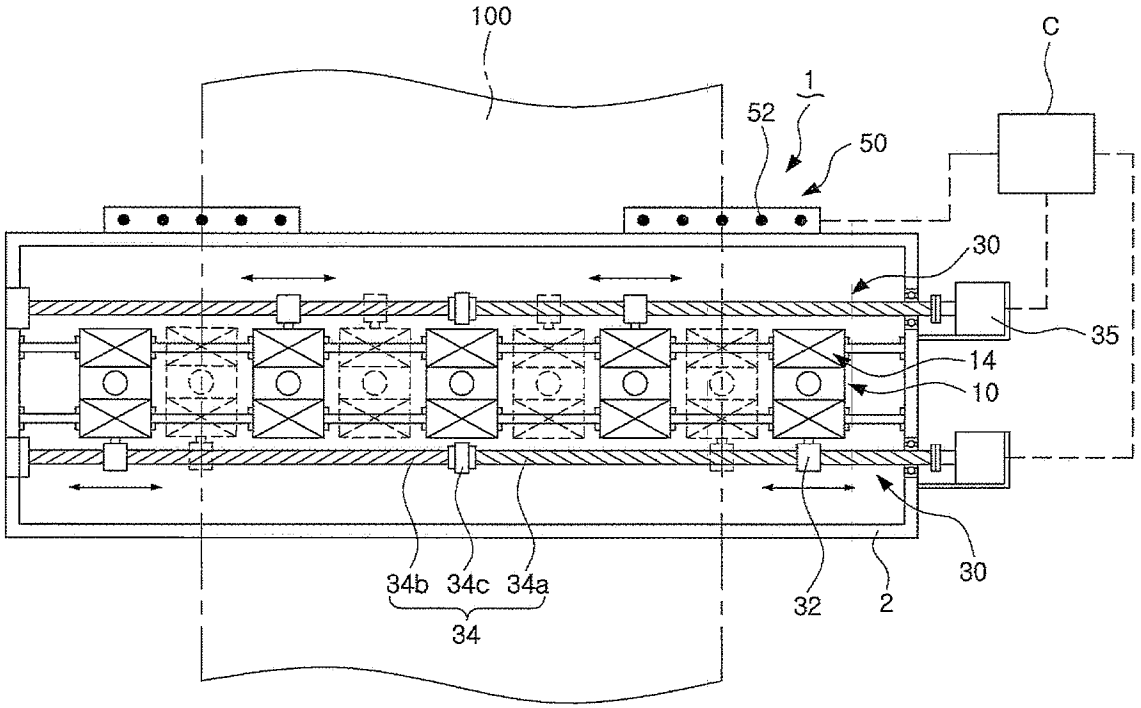
FIG. 3 is a front view showing the entire configuration of a steel strip stabilizing apparatus according to the present invention.
Figure 4:
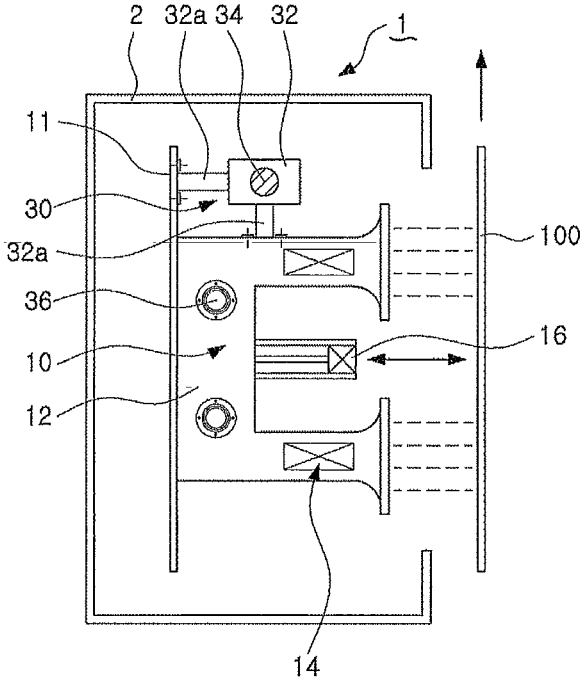
FIG. 4 is a side view of the steel strip stabilizing apparatus of FIG. 3.

First, as shown in FIGS. 2 to 4, the steel strip stabilizing apparatus 1 may be, for example, configured to include a plurality of steel strip damping means 10 arranged, toward the steel strip, on at least one side of a steel strip being processed so as to damp vibrations in the steel strip or to correct the shape of the steel strip; and a damping means moving unit 30 connected to the steel strip damping means 10 to move at least a portion of each of the steel strip damping means in a widthwise direction with regard to the steel strip corresponding to the width of the steel strip.

Therefore, as shown in detail in FIG. 5, the steel strip stabilizing apparatus 1 of the present invention, configured to correspond to the width of the steel strip, moves each of the steel strip damping means 10 by using the damping means moving unit 30 to control vibrations, enhance the shape correction capability, and in advance remove an instable element so as to prevent the damping force or the shape correction capability from being reduced due to a discontinuous boundary surface generated when an edge portion of the steel strip is positioned in a space (gap) between the steel strip damping means (units) 10, or so as to prevent the vibrations in the steel strip from being increased due to an instable damping or shape correction.

Figure 5A:
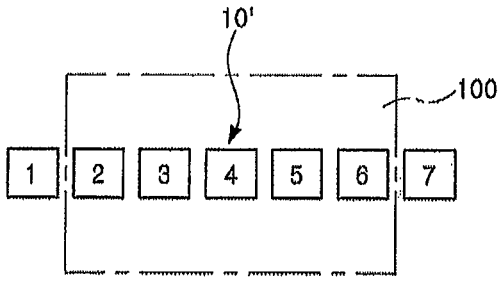
PRIOR ART FIG. 5A
FIGS. 5A and 5B are schematic views for explaining differences in operation between an existing steel strip stabilizing apparatus and a steel strip stabilizing apparatus according to the present invention.
Figure 5B:
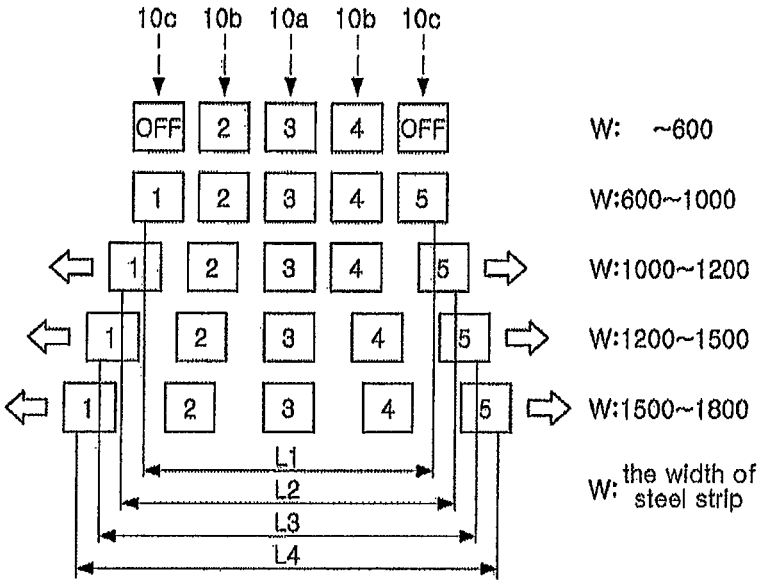

For example, schematic views for comparison between the existing device and the device of the present invention are shown in FIGS. 5A and 5B.

That is, as shown in FIG. 5A, unit damping means 10' (i.e., damping means 1 (#1) to damping means 7 (#10)) (which may have a similar structure to that of the present invention shown in FIG. 2) are arranged in the widthwise direction with regard to the steel strip unlike the present invention.

Therefore, in the case of the existing device, since the damping means are fixedly arranged and are difficult to move as shown in FIG. 5A, when an edge of the steel strip 100 is positioned in a space between the unit damping means, damping force between other portions of the steel strip and the edge thereof, i.e., the intensity of an applied magnetic field (see FIG. 4) may be different from each other.

Eventually, since a discontinuous boundary surface is generated in the case of the existing device, a reduction in damping force or shape correction capability at an edge portion of the steel strip or amplification of vibration occurs.

However, in the case of the present invention, moving side unit damping means 10*b* and 10*c* positioned on both sides of the central side unit damping means 10*a* based on the center of a traveling steel strip move in a combination of one pair at the same moving rate.

Thus, in the case of the present invention, even when the width of the steel strip is changed from L1 to L4, since an edge of the steel strip is at least positioned at the center of the moving side damping means 10*c*, the influence range of the magnetic field for damping of the steel strip may be made uniform in the widthwise direction with regard to the steel strip.

Eventually, since the present invention includes the moving side damping means 10*b* and 10*c* that are movable in the widthwise direction with regard to the steel strip, it becomes possible to more precisely and certainly realize the suppression of vibrations or the shape correction, such as curvature, compared with the existing device.

Meanwhile, as shown in FIGS. 2 to 4, the steel strip damping means 10 of the steel strip stabilizing apparatus 1 which realizes the vibration damping or shape correction of the steel strip includes a body part 12, disposed in the same installation environment on at least one side of the traveling steel strip, or preferably on both sides of the traveling steel strip, and at least one magnetic generating pole 14 provided to the body part 12 so as to damp vibrations in the steel strip or correct the shape of the steel strip.

At this time, the damping means body part 12 and the magnetic field generating pole may be actually formed in an integral type of casing structure.

Preferably, body part 12 shaped as a "⊏" and having the two magnetic field generating poles 14 is fixed to a plate type of damping means support 11, and the damping means support 11 may be fixed to a apparatus casing 2.

At this time, the damping means support 11 may have a plate shape extended in the traveling direction of the steel strip 10, as shown in FIGS. 1 to 4, or may be preferably manufactured of a non-magnetic material, for example, a ceramic or stainless steel (SUS) so as to prevent a magnetic field from being leaked when electromagnetic force is generated.

Meanwhile, in the steel strip stabilizing apparatus 1 of the present invention, although not shown in the drawings, the magnetic field generating pole 14 of the steel strip damping means 10 may be provided in a coil type damping means magnetic field generating pole including a core member made of a magnetic material, and an electromagnetic coil wound on the core member.

For example, an electromagnetic coil generating electromagnetic force when current is applied is wound on a core member configured by laminating SM45C series steel sheets or silicon steel sheets to configure a magnetic field generating pole, and the magnetic field generating pole is then covered by a cover body, for example, a non-magnetic cover body made of a synthetic resin or stainless steel having no influence on the electromagnetic force such that plated particles or other foreign particles are not held or accumulated between coils.

Alternatively, in the steel strip stabilizing apparatus, the magnetic field generating pole may be provided in the form of a magnet, such as a permanent magnet or electromagnet.

Figure 6:
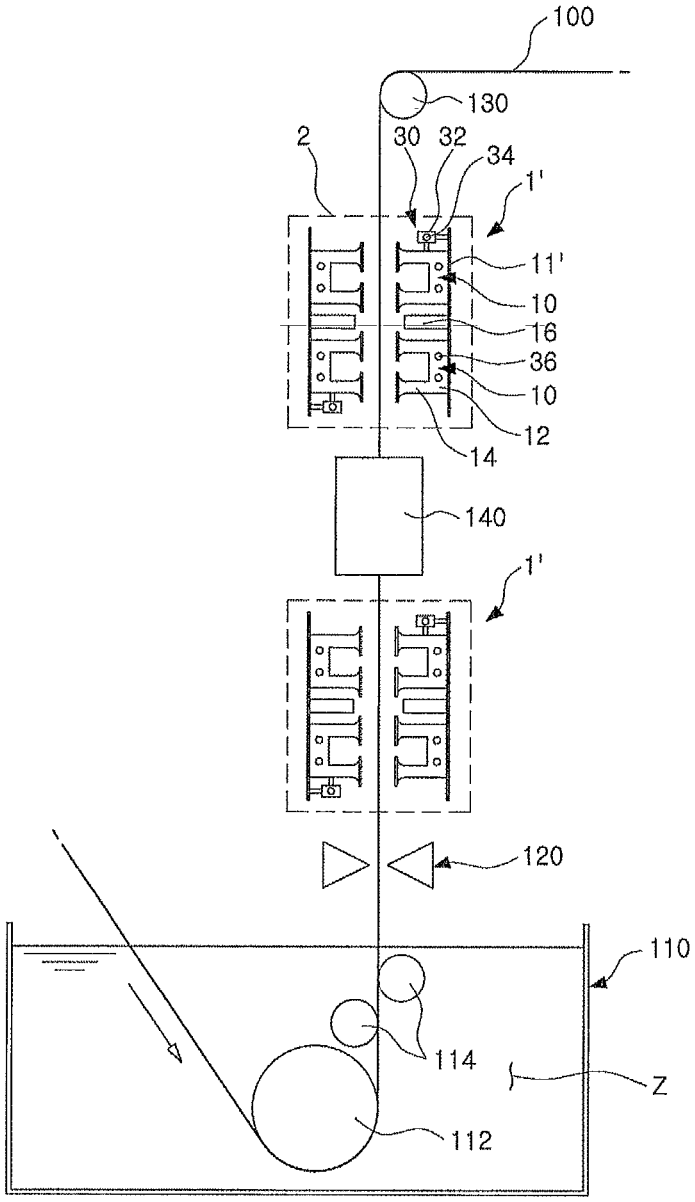
FIG. 6 is a schematic view of a steel strip stabilizing apparatus according to another modified example of the present invention.

At this time, as shown in FIG. 6, a plurality of unit damping means 10 are arranged in a vertical direction on an extended damping means support 11' unlike FIG. 1, and a sensing part 16 may be provided between the plurality of unit damping means 10.

It is of course natural in the case of FIG. 6 that at least a portion of the unit damping means 10 may be configured to be movable in the widthwise direction with regard to the steel strip corresponding to the width of the steel strip.

In the case of FIG. 6, since the scale of the steel strip stabilizing apparatus increases, but the damping width (range) or correction width of the steel strip actually extends, it becomes possible to more precisely damp vibrations in the steel strip or correct the shape of the steel strip.

At this time, the sensor part 16 shown in FIGS. 1, 3, and 6 may be an eddy current sensor or a known laser distance sensor, provided to the body part 12 between the magnetic field generating poles 14, or provided on the damping means support 11 between the unit damping means to sense the interval (represented by arrow in FIG. 4) between the magnetic field generating poles and the steel strip.

Of course, these sensors may be connected to a device controller (C) and may be controlled and driven by the device controller (C).

Next, in the device of the present invention shown in FIGS. 2 to 4 and 6, the damping means moving unit 30 which substantially moves the damping means is rotatably provided to the apparatus casing 2 in the widthwise direction with regard to the steel strip, and may be configured to include a screw bar 34 to which a moving block 32 connected to the body part is connected, and at least one guide 36 which penetrates the steel strip damping means body part 12 and is provided to the apparatus casing 2.

At this time, as shown in FIGS. 2 to 4, in the device of the present invention, the screw bar 34 is comprised of double screw bars 34*a* and 34*b* having different screw directions with the central side damping means 10*a* as a starting point as shown in FIG. 5B, a coupling mechanism 34*c* is disposed at a connecting portion between the double screw bars 34*a* and 34*b*, and the screw bars are connected to a driving motor 35 horizontally equipped in the apparatus casing 2 by using a bracket.

The double screw bars 34*a* and 34*b* of the screw bar 34 in the device of the present invention may be coupled to the moving blocks 32 to which the damping means 10*b* (#2) and the damping means 10*c* (#3) positioned on both sides of the reference damping means 10*a* are coupled in pairs on the left and the right.

At this time, the moving blocks 32 may be rigidly connected to a skin (no reference numeral) of the body part of the damping means and the damping means support 11 through a bracket 32*a*.

Preferably, as shown in FIGS. 2 to 4, the screw bar 34 of the moving unit 30 according to the present invention is respectively disposed at upper and lower sides of the damping means in the traveling direction of the steel strip and is connected to the respective moving blocks.

Meanwhile, as shown in FIG. 4, the driving motor 35 connected to the screw bar of the damping means moving unit 30 and is equipped in the apparatus casing 2 may be preferably electrically connected to the device controller (C).

Additionally, more preferably, a steel strip edge sensor 50 for sensing both edges of the traveling steel strip may be properly provided to upper ends of the apparatus casing 2.

Also, proximity sensors 52 may be actually installed in the steel strip edge sensor 50 to precisely sense the edges of the steel strip even when the width (W) of the steel strip is changed variously as shown in FIG. 5*b*, and the sensor may be connected to the device controller (C) as shown in FIG. 4.

Therefore, even when the width of the steel strip is changed variously as shown in FIGS. 2 to 4 while referring to FIG. 5B, the device of the present invention senses such a change, and moves the moving side damping means 10*b* and 10*c* positioned on both sides of the central side damping means 10*a* except for the central side damping means 10*a* at the same rate through the device controller (C) such that the edges of the steel strip pass through the center of the outermost damping means 10*c*, thus removing a discontinuous boundary surface to effectively damp vibrations in the steel strip or correct the shape of the steel strip.

Preferably, as shown in FIGS. 4 and 5B, the two moving side damping means 10*b* and 10*c* in a pair are disposed on both sides of the central side damping means 10*a* such that the same moving ratio (width) is obtained by the upper and lower screw bars 34.

In this regard, if the damping means move at different widths, the magnetic field influence distribution on the steel strip may locally deviate from the normal distribution and thus the vibrations in the steel strip may be rather amplified.

Meanwhile, when the double damping means 10 (provided in the same column as shown in FIGS. 2 and 3 in the widthwise direction with regard to the steel strip) are provided to the one extended damping means support 11', the moving units 30 may be disposed diagonally, or may be configured in connection with the upper and lower unit damping means, respectively.

In this regard, as shown in FIG. 2, a guide 36 of the moving unit 30 penetrating the damping means 10 is provided to the body part 12 to stably support the movement of the damping means 10 having a weight in the widthwise direction with regard to the steel strip.

For example, the guide 36 may be a bar having a predetermined diameter, and may be connected to a ring shaped guide support block 36*a* assembled into a penetration hole formed at the body part 12 of the damping means 10 through a liner ring 36*b*.

Therefore, the liner ring 36*b* of the present invention may move together with the guide while the damping means moves, such that the damping means may move smoothly and a factor hindering movement may be removed.

Although not represented in the drawings by a separate reference numeral, the screw bar 34 and the guide 36 of the moving unit 30 may be assembled while supporting the weight of the damping means by using a bearing block, a support ring, a fixing ring, and the like.

Figure 7:
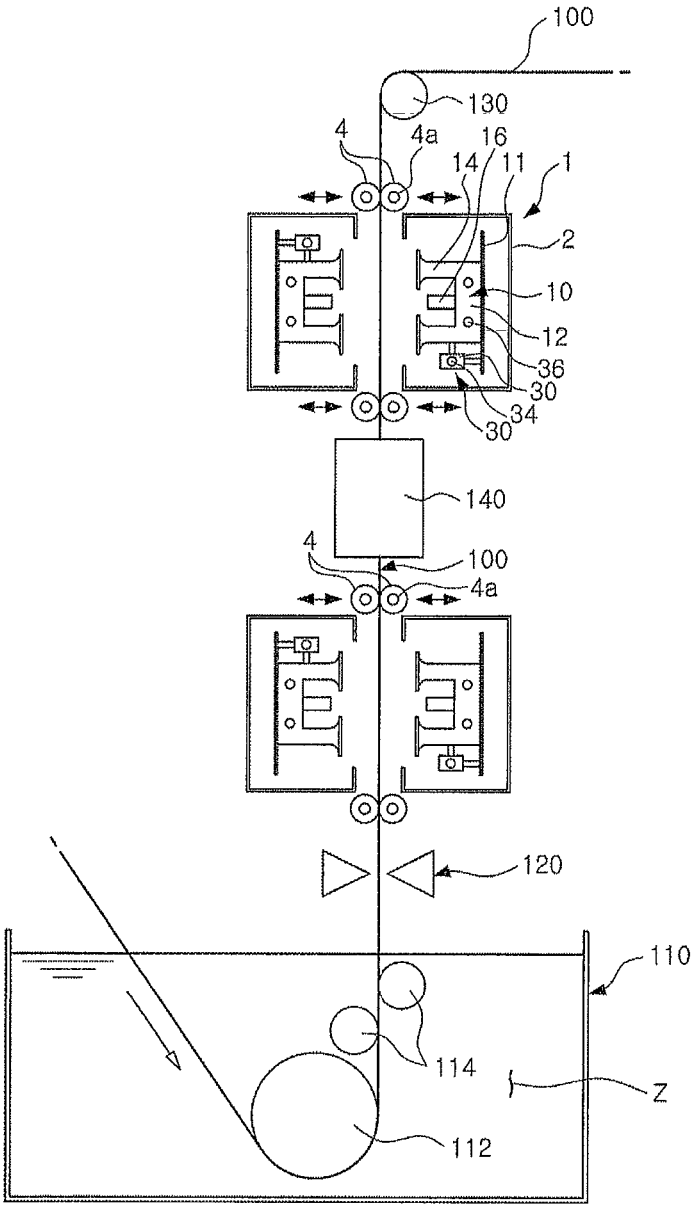
FIG. 7 is a schematic view showing an example modified from the steel strip stabilizing apparatus of FIG. 1.

Next, the steel strip transfer roll 4 installed at a steel strip traveling portion of the casing of the steel strip stabilizing apparatus of FIG. 1 is shown in FIG. 7.

For example, the steel strip transfer roll 4 installed in the casing 2 may be provided in the form of a feeding roll installed on a driving shaft 4*a* transferring driving force from a motor (not shown), or in the form of an idle guide roll through which a driving force is not transferred.

It is of course preferable that the steel strip transfer rolls 4 are installed on the driving shaft 4*a* to transfer the steel strip corresponding to the traveling speed (line speed) of the plated steel strip while transferring a driving force.

Then, the steel strip transfer roll prevents generation of defects, such as scratches on the surface of the steel strip when the steel strip passing through the apparatus casing 2 contacts the casing 2, regardless of whether the steel strip transfer roll is a feeding roll or a guide roll.

Additionally, the steel strip transfer roll 4 allows the steel strip to move while constantly maintaining the interval between the steel strip damping means 10 and the steel strip.

According to the present invention, unit damping means are movable to prevent the damping capability or the shape correction capability from being reduced on at least the edge portion of the steel strip, to prevent the amplification of vibrations and to remove curvature of the steel strip, thus improving the plated quality of the steel strip.

Also, the present invention solves the existing problem at the edge portion of the steel strip even when the number of the unit damping means (blocks) is decreased, thus decreasing maintenance costs.

The invention claimed is:

1. A steel strip stabilizing apparatus comprising:

a plurality of steel strip dampers arranged on at least one side of a steel strip undergoing processing in a direction there towards so as to damp vibrations in the steel strip or to correct the shape of the steel strip; and a damper moving unit connected to the steel strip dampers to move at least a portion of each of the steel strip dampers in a widthwise direction with regard to the steel strip corresponding to the width of the steel strip, wherein at least one of the steel strip dampers comprises a central side damper disposed at a traveling center of the steel strip, and at least one moving side damper arranged on both sides of the central side damper in a widthwise direction with regard to the steel strip and connected to the damper moving unit, wherein the damper moving unit comprises a screw bar rotatably provided to an apparatus casing in the widthwise direction with regard to the steel strip and is coupled to a moving block connected to a body part of the steel strip damper, and at least one guide provided to the apparatus casing while passing through the body part of the steel strip damper, wherein the screw bar is comprised of double screw bars having different screw directions that are opposite each other with the central side damper as a starting point, and when the screw bar rotates, the moving side dampers positioned on both sides of the central side damper are moved closer to or distant from each other with the same moving width in opposite directions, and the screw bar is alternately connected to the moving side dampers at upper and lower sides thereof, and wherein a driving motor connected to the screw bar of the damper moving unit and equipped in the apparatus casing is connected to a device controller, and a steel strip edge sensor provided on both sides of the apparatus casing is connected to the device controller.

2. The steel strip stabilizing apparatus of claim 1, wherein at least one of the steel strip dampers comprises:

a body part disposed on at least one side of the traveling steel strip; and at least one magnetic field generating pole provided to the body part to damp the vibration or to correct the shape of the steel strip.

3. The steel strip stabilizing apparatus of claim 1, wherein the guide of the damper moving unit is provided to allow the dampers to be easily moved while passing through a liner ring provided to a guide support block attached to the body part of at least one of the steel strip dampers.

* * * * *